United States Patent [19]

McNally

[11] 4,250,941

[45] Feb. 17, 1981

[54] AUTOMATIC SEALING APPARATUS FOR OVERHEAD DOORS

[76] Inventor: John P. McNally, 14 Zanoni St., Woodcliff Lake, N.J. 07675

[21] Appl. No.: 71,664

[22] Filed: Aug. 31, 1979

[51] Int. Cl.[3] ..... E05D 15/00

[52] U.S. Cl. ..... 160/209; 49/477

[58] Field of Search ..... 160/209, 201; 49/197-200, 477

[56] References Cited

U.S. PATENT DOCUMENTS

| | | | |
|---|---|---|---|
| 2,827,114 | 3/1958 | Stroup | 160/209 |
| 3,090,427 | 5/1963 | Stroup et al. | 160/209 |
| 3,100,918 | 8/1963 | Coverley | 49/477 |

*Primary Examiner*—Peter M. Caun

*Attorney, Agent, or Firm*—Albert F. Kronman

[57] ABSTRACT

Sealing apparatus for overhead doors in which a horizontally disposed elastomeric reservoir containing a quantity of fluid is secured to a header above the door and spaced tubular elastomeric members are secured at each side of the door to the building structure. The tubular members are in fluid communications with the fluid in the reservoir. An elongated flat bar secured to the top of the door bears against the reservoir when the door is closed causing fluid to be forced into the tubular members, extending them into sealing contact with the side edges of the door, while the reservoir seals the edges along the top of the door. Opening of the door releases the fluid pressure permitting the tubular members to retract and return fluid to the reservoir.

8 Claims, 8 Drawing Figures

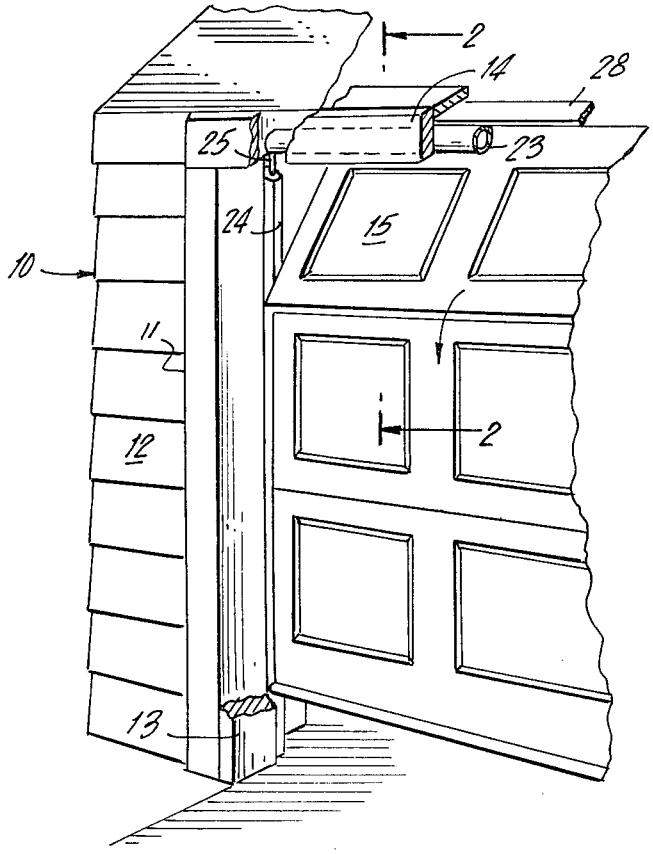
FIG. 1
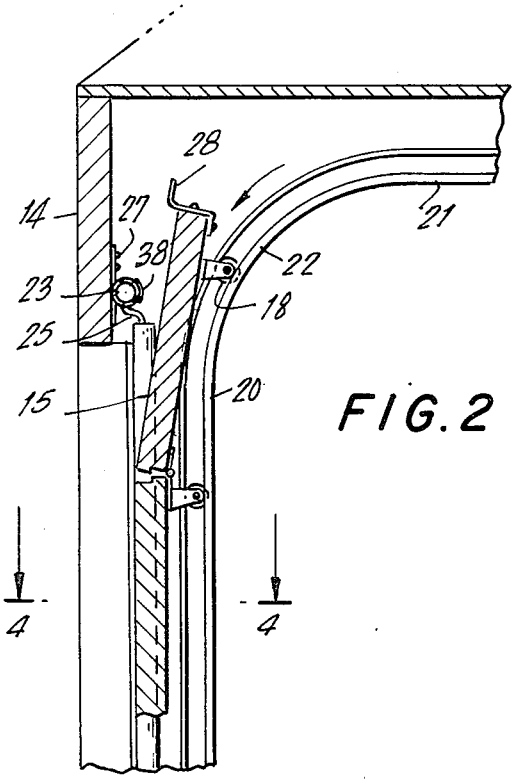
FIG. 2
FIG. 3
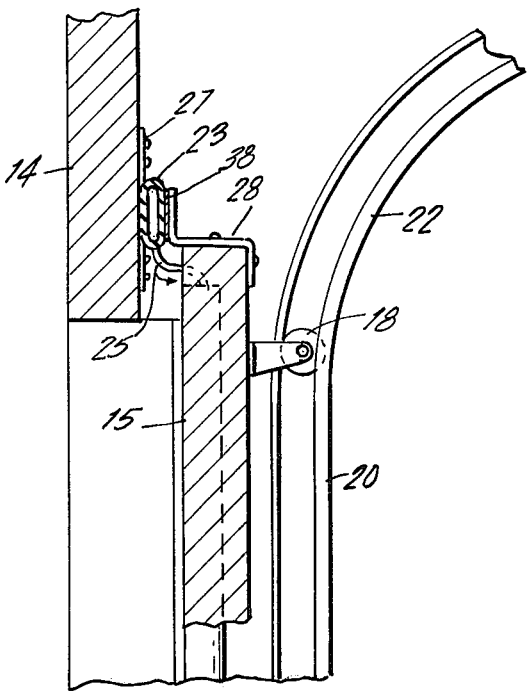

FIG. 4
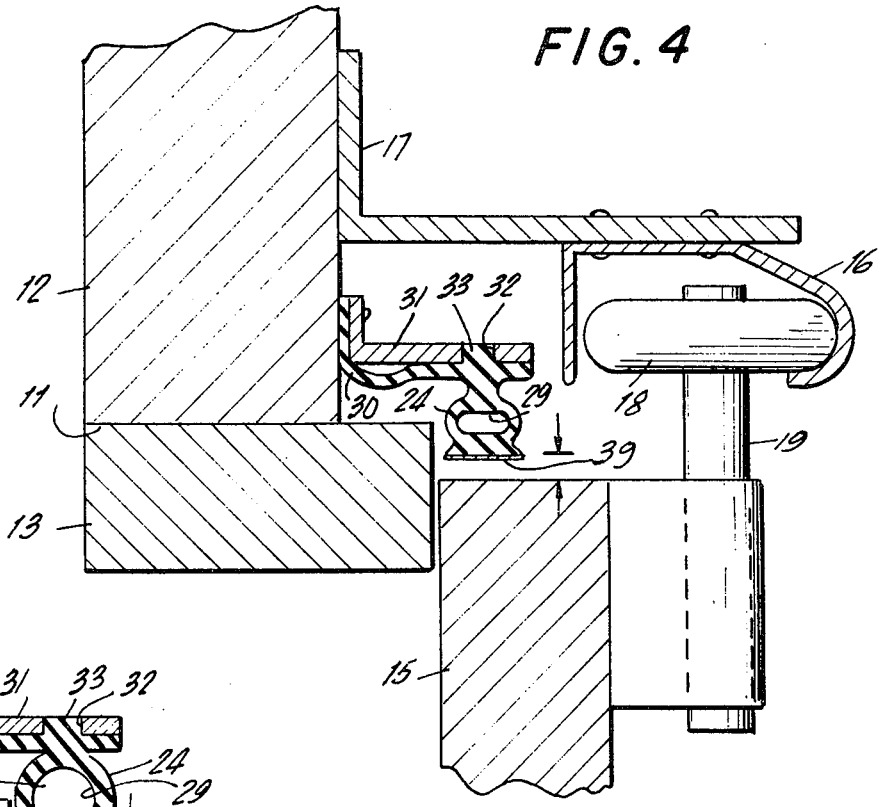
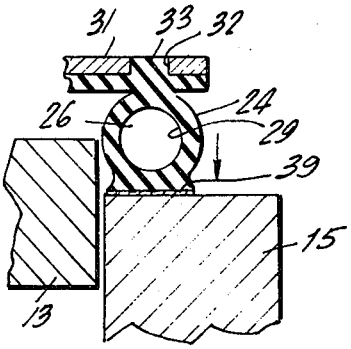
FIG. 5
FIG. 7
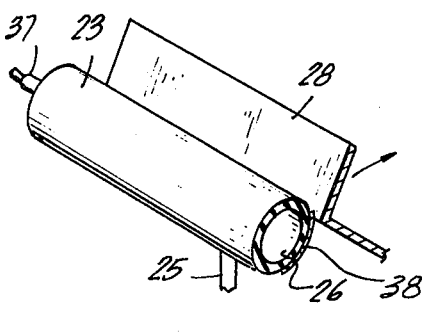
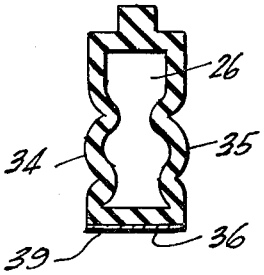
FIG. 6
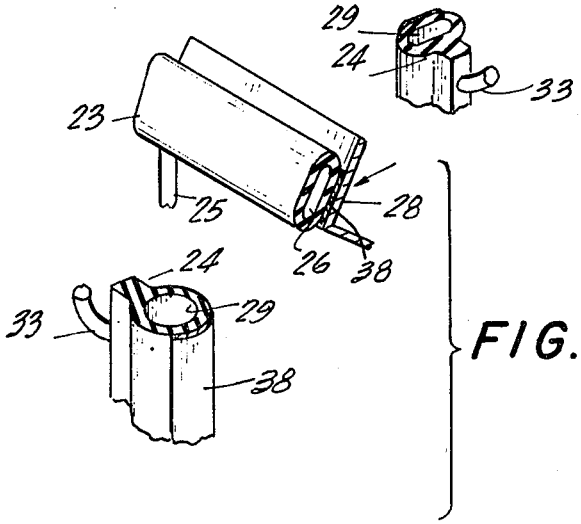
FIG. 8

AUTOMATIC SEALING APPARATUS FOR OVERHEAD DOORS

BACKGROUND OF THE INVENTION

Doors, such as overhead garage doors which open or are closed by sliding them vertically up and down present serious problems where it is desired to seal the edges of the doors against weather conditions. In order to move freely the doors must be spaced from the supporting structure and if insulation such as weather strip is placed between the door and the supporting structure it becomes worn due to the frictional contact with the door. While the bottom of the door presents no such problem the sides and top of the door are constant sources of air and rain leaks.

Accordingly, it is an object of the present invention to overcome the shortcomings of prior known devices by providing a simple durable structure for attachment to the frame of the door which will seal the space between the frame and the door.

Another object of the present invention is to provide a door sealing structure which employs pneumatic means and elastomeric sealing members which retract and expand in response to the opening and closing of the door.

A further object of the present invention is to provide a door sealing means which will operate automatically in response to the closing and opening of the overhead door.

A feature of the present invention is its use of a pneumatic reservoir in communication with elongated elastomeric hollow sealing members.

Another feature of the present invention is its simplified construction which will permit of an easy installation.

SUMMARY OF THE INVENTION

A pneumatic sealing apparatus according to the present invention comprises an elongated hollow reservoir made of a suitable elastomer material containing a fluid such as air, liquid or the like. The reservoir is attached to the upper horizontal portion of the door frame on the inside thereof. An elongated tubular seal member is secured to the vertical sides of the door frame and the interior of the tubular members are in communication with the fluid in the reservoir. Means carried by the top of the door are provided whereby as the door is closed the reservoir is compressed. The compression of the reservoir forces fluid into the tubular sealing members causing them to expand against the adjacent surfaces of the door thereby providing a seal.

The door is mounted upon a track in the well-known manner so that as the door is initially raised it is directed rearwardly by a curved portion of the track following which the door is slipped upwardly and along a horizontal path into a completely open position. The initial movement of the door is opening releases the pressure on the elastomeric reservoir thereby permitting the fluid to be forced out of the elongated tubular seals and back into the reservoir due to the natural resiliance of the tubular seals. Sealing contact with the surfaces of the door is thus released and wear of the sealing members prevented.

DESCRIPTION OF THE DRAWINGS

In the accompanying drawings forming a part hereof, similar parts have been given identical reference numbers in which drawings:

FIG. 1 is a somewhat isometric fragementary view of an overhead opening door and a portion of the building structure in which it is retained.

FIG. 2 is a cross sectional view taken on line 2—2 in FIG. 1.

FIG. 3 is a view similar to FIG. 2, somewhat enlarged showing the door in the closed position.

FIG. 4 is a cross sectional fragmentary view taken on line 4—4 in FIG. 2, somewhat enlarged, in the open position.

FIG. 5 is a detailed cross sectional view showing the tubular seal in the closed position.

FIG. 6 is a cross sectional view of another form of a tubular seal useful in the present invention in an expanded mode.

FIG. 7 is a fragementary exploded view of the sealing elements of the present invention in the open position.

FIG. 8 is a view similar to FIG. 7 showing the action of the apparatus as the overhead door is closed.

DESCRIPTION OF THE PREFERRED EMBODIMENTS

Referring to the drawings, and particularly to FIGS. 1–4, there is shown a building structure 10 having an opening 11 in its exterior wall 12 to receive the casing 13 and header 14 for a door 15.

The door 15 is of the overhead type in that it is opened by raising it vertically and sliding it along track members into an overhead horizontal position. The door 15 may be made of elongated horizontal panels or segments hinged together, as shown, or as a unitary flat member. It may be raised and lowered manually or by means of motor driven mechanisms well-known in the art.

In order to shift the position of the door 15 from its vertical, closed, position to the overhead, horizontal or open orientation there are provided spaced track members 16 best shown in FIGS. 2 and 3. The track members are secured at each side of the door opening 11 by means of steel angles 17 or other suitable supports fastened to the inside of the wall 12 (see FIG. 4). Rollers 18, freely carried upon the ends of shafts 19 secured to the rear of the door 15 ride within the track members which are somewhat channel shaped.

The track members 16 are formed so as to guide the door 15 along its desired path of travel. This is accomplished by a vertical track portion 20, a horizontal top portion 21 and a curved portion 22 between the vertical and horizontal portions 20, 21 where the travel of the door changes from vertical to horizontal.

As shown in FIGS. 1 and 2, the first movement of the top of the closed door 15 as it begins its travel is inwardly or away from the header 14 across the top of the door opening 11. When the door is brought into its closed position, as shown in FIG. 3, the top of the door 15 will bear against the header.

In the present invention the customary movement of the top of the door 15 is used to operate a sealing apparatus. The sealing apparatus generally comprises an elongated hollow reservoir 23 secured to the inside of the header 14 above the door opening 11, and two spaced elongated tubular seal members 24 carried on the inside of the outer wall 12 adjacent the casing 13 and parallel with the said casing. The reservoir 23 and the tubular members 24 are made of a suitable elastomeric material such as natural or synthetic rubber, well-known in the door sealing art, and of sufficient wall thickness to withstand repeated cycles of flexing.

Small fluid lines 25 interconnect each of the tubular members 24 with the reservoir 23 so that fluid 26 within the reservoir is free to pass into and out of the said tubular members. The fluid employed in the sealing apparatus may be air, an inert gas or any suitable liquid such as water, with or without an additive to prevent freezing.

The reservoir 23 is secured to the header 14 by any suitable means such as the flanges 27 shown in FIGS. 2 and 3. The flanges 27 may be integral with the body of the reservoir or bonded thereto. The reservoir is also disposed in the path of an elongated "Z" bar 28 secured to the top edge of the door 15. It will be seen from an examination of FIGS. 2, 3, 7 and 8 that as the door 15 is closed, the Z bar 28 will squeeze a certain amount of the fluid 24 out of the reservoir 23. When the door is moved upwardly, the Z bar will release the reservoir permitting fluid to reenter the reservoir.

Since the tubular members 24 are in fluid communication with the interior of the reservoir 23, fluid squeezed out of the reservoir will be forced into the elongated opening 29 of each of the said tubular members. This force will expand the tubular members in the direction of the adjacent edges of the door to form a seal as indicated in FIG. 5 and in dashed lines in FIG. 4.

The elongated tubular members 24 are so constructed that they will act as bellows, expanding in one direction on the application of pneumatic or hydraulic force and retracting by their own resilience when the force is substantially reduced.

Two suggested forms of elongated tubular members 24 are shown in FIGS. 4, 5 and 6 but other shapes may be used without departing from the spirit of the invention.

The tubular seal member 24 shown in FIGS. 4 and 5 is provided with a flanged portion 30 which is used to secure the tubular member to the wall 12 of the building. A rigid angle iron 31 supports the back of the tubular seal member and is provided with openings 32 to receive buttons 33 on the tubular seal member which are thrust therethrough. The angle iron 31 prevents the tubular seal member from becoming deflected from its operative position. The tubular member is preferably extruded and made with a wall thickness about the elongated opening 29 such that the structure will return to its original shape upon the release of fluid pressure. The elasticity of the body of the tubular member should be sufficiently great to force fluid out of the opening 29 and back into the reservoir 23 by way of the fluid lines 25 when the pressure on the reservoir is released by the "Z" bar 28.

The embodiment shown in FIG. 6 employs a bellows type tubular member 34 in which the corrugated sidewalls 35 contribute to the movement of the sealing face 36 of said tubular member. The illustration of FIG. 6 is in the retracted or unpressurized position and on the application of internal fluid pressure the sidewalls 35 will become straightened to elongate the assembly in the direction of the edge of the door 15.

When installing the door sealing apparatus according to the present invention the parts are assembled and secured in place in the manner described above. The fluid is then forced into the reservoir 23 by means of a small valve 37 (best shown in FIG. 7). This fluid may be introduced by means of a pump such as an air pump or fluid line under pressure. The fluid is introduced while the door is in the closed position and the reservoir compressed by "Z" bar. Sufficient pressure is applied to cause the elongated tube sealing members to extend into sealing contact with the edges of the door. The door is then ready for operation. It is noted that when the reservoir 23 is flatened against the header 14 it provides a seal along the top of the door. The small areas between the reservoir and the elongated tubular sealing member may be covered by flaps or any other suitable means (not shown).

In order to prevent rapid wear elongated friction shoes in the form of metal or suitable plastic plates 38, 39, may be bonded to the rear faces of the reservoir 23 and the seal members 24, 34, as shown in FIGS. 1–6.

Having thus described the invention, what is claimed as new and is desired to be secured by Letters Patent is:

1. Sealing apparatus for overhead doors comprising in combination with a building structure wall, an opening in said wall, spaced vertical casing members on each side of said opening and secured to the wall, a horizontal header overlying the casing members in the opening and secured to the casing members and the wall, elongated, spaced track members secured at each side of the opening to the wall said track members being somewhat channel shaped in cross section and having a vertically disposed portion, a horizontally disposed top portion and a curved portion between the said vertical and horizontal portions, a door received within the opening and peripherally overlying a portion of the casing members and the header, rollers carried by the door in operative engagement with each of the track members to lead the door from a vertical, closed position, to an overhead, horizontal, open position, an elongated elastomeric hollow reservoir secured to the header and extending across the inside surface thereof, spaced elongated elastomeric tubular seal members vertically disposed on each side of the opening adjacent the door, a fluid line to connect the interior of each of the tubular seal members with the interior of the reservoir, a quantity of fluid internally carried by the said reservoir and the tubular seal members, and an elongated bar secured to the top of the door and disposed so as to compress the tubular reservoir when the door is in its closed position.

2. Apparatus according to claim 1 in which the reservoir is provided with flanged portions for attachment to the header.

3. Apparatus according to claim 1 in which the reservoir is provided with valve means in communication with the interior of the said reservoir to receive fluid therethrough.

4. Apparatus according to claim 1 in which the reservoir in the compressed state forms a seal across the top of the door.

5. Apparatus according to claim 1 in which the elongated tubular seal members are extensible, in response to increased fluid pressure from the compressed reservoir, to a position of contact with the adjacent edges of the door.

6. Apparatus according to claim 5 in which the tubular seal members are formed with a sealing face disposed in the direction of the adjacent door edges.

7. Apparatus according to claim 5 in which the elongated tubular seals are in the form of bellows.

8. Apparatus according to claim 5 in which the tubular seals are made with walls of sufficient thickness and resilience that they will return to their original shape upon the release of internal fluid pressure.

* * * * *